US011358743B2

(12) United States Patent
Speck et al.

(10) Patent No.: US 11,358,743 B2
(45) Date of Patent: Jun. 14, 2022

(54) TUBE HOLDER FOR A TUBE-FILLING MACHINE

(71) Applicant: IWK VERPACKUNGSTECHNIK GMBH, Stutensee (DE)

(72) Inventors: Markus Speck, Bruchsal (DE); Andreas Siegele, Stutensee (DE); Rudolf Hörter, Wörth (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 56 days.

(21) Appl. No.: 16/500,647

(22) PCT Filed: Jun. 1, 2018

(86) PCT No.: PCT/EP2018/000283

§ 371 (c)(1),
(2) Date: Oct. 3, 2019

(87) PCT Pub. No.: WO2018/228719

PCT Pub. Date: Dec. 20, 2018

(65) Prior Publication Data

US 2020/0108961 A1 Apr. 9, 2020

(30) Foreign Application Priority Data

Jun. 14, 2017 (DE) ..... 10 2017 005 610.2

(51) Int. Cl.
*B65B 43/54* (2006.01)
*B65B 3/16* (2006.01)

(52) U.S. Cl.
CPC ..... *B65B 43/54* (2013.01); *B65B 3/16* (2013.01)

(58) Field of Classification Search
CPC .. B65B 3/04; B65B 3/16; B65B 43/43; B65B 43/54
See application file for complete search history.

(56) References Cited

U.S. PATENT DOCUMENTS 3,819,194 A 6/1974 Grevich et al.
4,819,789 A * 4/1989 Linner ..... B65B 3/16 141/129

(Continued)

FOREIGN PATENT DOCUMENTS

DE 2351762 A1 4/1974
DE 69209299 T2 11/1996

(Continued)

OTHER PUBLICATIONS

International Search Report with English translation corresponding to International Application No. PCT/EP2018/000283, dated Aug. 6, 2018 (7 pages).

(Continued)

*Primary Examiner* — Nicolas A Arnett
(74) *Attorney, Agent, or Firm* — Flynn Thiel, P.C.

(57) ABSTRACT

A tube holder for a tube-filling machine has a cup-shaped housing which comprises an upwardly opening tube receiving means into which a tube is insertable by way of one axial end region thereof. A clamping device, by which a clamping force can be applied to the tube, is arranged in the region of the tube wall of the tube receiving means. It can be provided in this case that that the clamping device comprises at least one magnet which is movable by at least one electric coil and/or at least one permanent magnet between a clamping position, in which a clamping force is applied to the tube, and a releasing position in which a clamping force is not applied to the tube. Alternatively, the clamping device can comprise a magnetorheological fluid, the viscosity of which is modifiable by at least one electric coil and/or at least one permanent magnet.

5 Claims, 5 Drawing Sheets

(56) References Cited

U.S. PATENT DOCUMENTS

Figure 1:
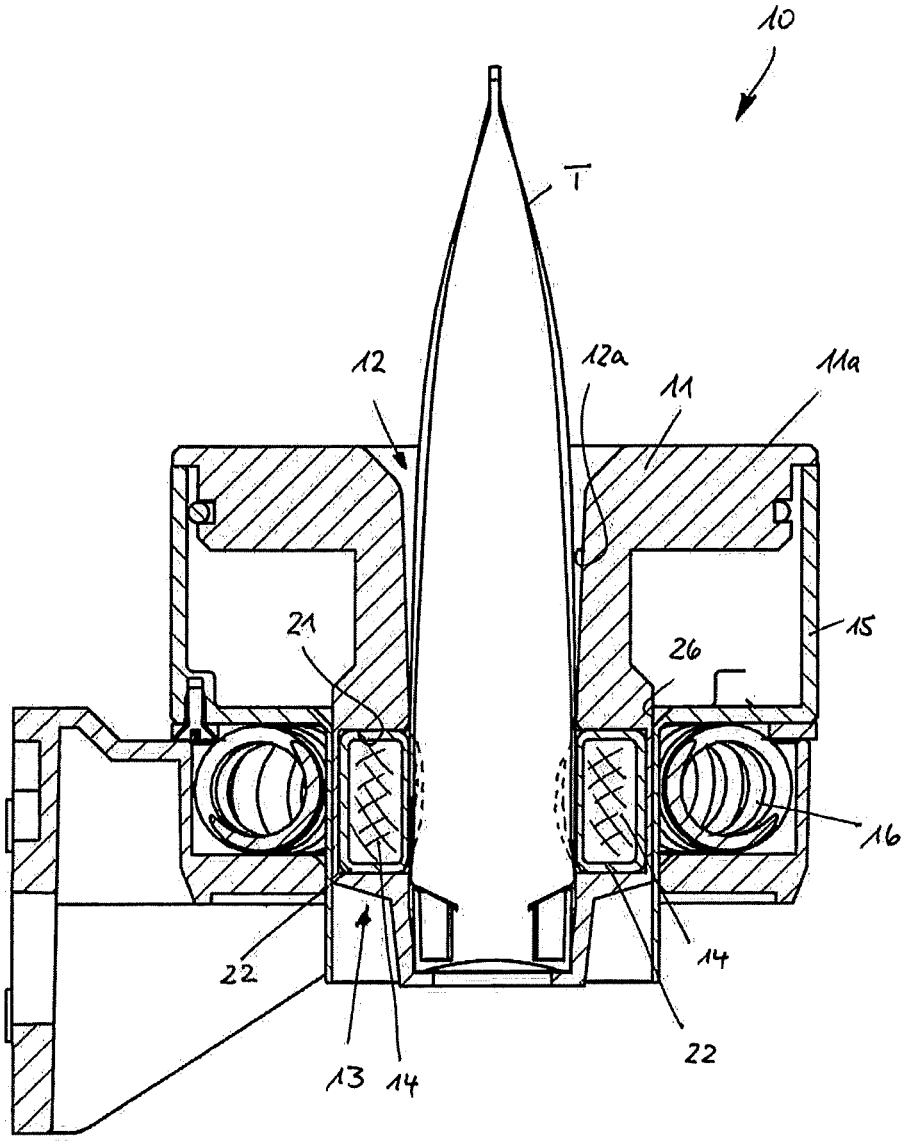

| | | | | |
|---|---|---|---|---|
| 4,958,667 | A * | 9/1990 | Rece | B65B 3/16 141/113 |
| 5,375,898 | A | 12/1994 | Ohmori et al. | |
| 7,784,603 | B2 * | 8/2010 | Burgmeier | B65G 47/90 198/472.1 |
| 8,210,546 | B2 | 7/2012 | Köhler | |
| 8,453,686 | B2 * | 6/2013 | Klaus | G01G 17/04 141/83 |
| 8,590,693 | B2 * | 11/2013 | Linke | B29C 49/4205 198/468.5 |
| 2020/0017247 | A1 * | 1/2020 | Speck | B65B 43/54 |

FOREIGN PATENT DOCUMENTS

| | | | |
|---|---|---|---|
| DE | 19920622 | A1 | 11/2000 |
| DE | 102006055854 | A1 | 5/2008 |
| SU | 1404336 | A1 | 6/1988 |

OTHER PUBLICATIONS

Written Opinion of International Searching Authority corresponding to International Application No. PCT/EP2018/000283 dated Aug. 6, 2018 (5 pages).

Office Action of German Patent Office corresponding to German Application No. 10 2017 005 610.2 dated Feb. 1, 2018.

* cited by examiner

TUBE HOLDER FOR A TUBE-FILLING MACHINE

The invention relates to a tube holder for a tube-filling machine, having a cup-shaped housing which comprises an upwardly opening tube receiving means into which a tube is insertable by way of its one axial end region, wherein a clamping device, by means of which a clamping force can be applied to the tube, is arranged in the region of the inner wall of the tube receiving means.

A tube-filling machine of usual design comprises an endlessly circulating conveying device which carries a plurality of receiving means into each of which a tube holder is inserted. A tube is able to be inserted from above into each tube holder by way of its head portion or cap portion, the tube, together with the tube holder, running through the individual working stations of the tube-filling machine. In certain working stations, for example the filling station and the closing station, it can be provided that the tube, with its tube holder, is raised from the receiving means and is introduced into the respective working station, it being lowered into the receiving means again once the working step has been completed. The filled and closed tube is removed from the tube holder in a removal station and transported away.

DE 10 2006 055 854 A1 discloses a tube holder of the named type where at least one clamping element, which is displaceable substantially perpendicularly to the longitudinal center axis of the tube receiving means and by means of which, under the effect of at least one spring element, a clamping force, which acts radially from outside onto the inserted tube, can be applied, is arranged in the region of the inner wall of the tube receiving means. The clamping element, in this case, is pivotably mounted.

The designations "above" and "below" used here refer to the usual alignment of a tube holder with a tube receiving means which opens upward, in which the tube is able to be inserted from above by way of its head portion or cap portion so that the tube projects from the top of the tube holder with its end which is to be welded. In the case of such an alignment of the tube holder, the longitudinal center axis thereof extends vertically and the clamping forces clamping the tube in the tube holder are applied substantially perpendicularly to the center longitudinal axis and consequently substantially horizontally.

In order to be able to operate the tube-filling machine at a high cycle rate, it is necessary for the tubes to be positioned precisely in the tube holder. In this case, the problem arises of many different shapes of tubes having to be processed with the tube-filling machine, in particular different shapes of cap and different shapes of tube body. It has been shown, furthermore, that the tubes are subject to relatively large dimensional tolerances, as a result of which it is very difficult to achieve precise positioning and in particular centering of the tube in the tube holder.

The object underlying the invention is to create a tube holder of the named type with which secure mounting and good centering of tubes in different formats is ensured.

In a first design of the invention, said object is achieved by a tube holder with the features of claim 1. In this case, it is provided that the clamping device comprises at least one magnet and preferably multiple magnets which are displaceable by means of at least one electric coil and/or at least one permanent magnet between a clamping position, in which a clamping force is applied to the tube, and a releasing position in which a clamping force is not applied to the tube.

The invention proceeds from the basic consideration of triggering the displacement movement by a driving force introduced from outside so that this can be adapted to the shape of the tube to be clamped. When the drive is effected by means of an electric coil, it is possible thereby to generate a magnetic field, by means of which the magnet or the magnets are able to be moved either from the clamping position into their releasing position or from the releasing position into their clamping position. Once the electrical field has been shut down, the magnet or the magnets return into their initial position, which can also be effected magnetically and/or due to elastic resetting forces and/or by means of a restoring spring. In a preferred design of the invention, it is provided that the initial position is the clamping position so that the tube is also held securely even if the electromagnetic field is not generated.

If the drive is effected by means of a permanent magnet, the polarity of the magnet can be aligned such that, on the one hand, the magnets and, on the other hand, the permanent magnets repel or attract when the tube holder with the magnets comes into the vicinity of the permanent magnets, as a result of which the tube is released. As an alternative to this, it can be provided that the polarity of the magnet is aligned such that the tube is clamped when the tube holder with the magnets comes into the vicinity of the permanent magnets.

The tube holder usually comprises a vertically aligned, channel-shaped tube receiving means. In a preferred design of the invention, at least one chamber, which extends radially outward from the tube receiving means and in which the magnet or the magnets are arranged, is realized in the inner wall of the tube receiving means, the magnet or the magnets being connected to a clamping part which is deformable by means of the magnet or by means of the magnets into a position projecting into the tube receiving means. In the releasing position, the clamping part is pulled back into the chamber so that it does not exert any clamping force on the tube inserted in the tube receiving means. In the initial position, the clamping part preferably projects into the tube receiving means. When by means of the electric coil and/or by means of the permanent magnet, a displacement of the magnet or of the magnets and consequently also of the clamping part is effected, the clamping part is displaced relatively to the tube receiving means such that the tube located there is released.

In a further development of the invention, it can be provided that the magnet or the magnets are embedded in the clamping part. The clamping part can be, for example, a body produced from a soft elastic, easily deformable plastics material which can fill out the chamber entirely in a further development of the invention and can be fixed in the same in a positive locking and/or non-positive locking manner, for example by means of an adhesive.

In a possible design of the invention, it can be provided that the chamber is realized as a circumferential annular chamber, multiple magnets being arranged in the chamber preferably distributed uniformly over the periphery.

In a further design of the invention, it can be provided that the magnet or the magnets are displaceable in the chamber longitudinally of the guide, the guide being able to comprise a bearing, for example a ball bearing. In this way, a defined displacement movement of the magnet or of the magnets is achieved between the clamping position and the releasing position.

The magnets can be mounted so as to be rotatable about the longitudinal axis of the tube receiving means. Said rotation or any other displacement of the magnet or of the magnets longitudinally of the guide can be transmitted to a clamping element, by means of which a clamping force can be applied to the tube.

In a second design of the invention, the object is achieved by a tube holder with the features of claim 10. In this case, it is provided that the clamping device comprises a magnetorheological fluid, the viscosity of which is modifiable by means of at least one electric coil and/or at least one permanent magnet. A magnetorheological fluid is a suspension of magnetically polarizable particles which are distributed finely in a carrier fluid. The magnetorheological fluid changes its viscosity when a magnetic field is applied. As the field intensity of a magnetic field increases, the viscosity of the magnetorheological fluid increases, i.e. it becomes more viscous.

Without the presence of a magnetic field, the viscosity of the magnetorheological fluid is relatively high. The tube is able to be inserted into the tube holder, the magnetorheological fluid holding the tube securely. When the tube is inserted into the tube receiving means or when the tube is removed from the tube receiving means, a magnetic field acts on the magnetorheological fluid by means of the electric coil and/or by means of the permanent magnet, as a result of which the viscosity of the magnetorheological fluid becomes low so that the magnetorheological fluid does not obstruct the insertion movement or the removal movement of the tube.

In a possible design of the invention, it is provided that the magnetorheological fluid is arranged in a liquid chamber which forms at least one portion of the inner wall of the tube receiving means with a flexible wall. When the tube is inserted into the tube receiving means, the magnetorheological fluid becomes flowable as a result of the effect of the magnetic field and is displaced in portions under deformation of the flexible wall and the tube is surrounded by the magnetorheological fluid in the region of its head and/or its shoulder with the interposition of the flexible wall. Once the magnetic field is no longer active, the magnetorheological fluid becomes so viscous again that it fixes the tube in the predefined position.

The fluid chamber is preferably realized as a fully circumferential annular chamber so that the tube is able to be fixed fully circumferentially by the magnetorheological fluid.

In a further development of the invention, it can be provided that the housing of the tube holder sits in a housing receiving means and can also be removed from said housing receiving means when necessary. In this case, the electric coil and/or the permanent magnet can be arranged on the housing receiving means or can be embedded in the same.

The housing receiving means is preferably realized in an annular manner so that the tube holder with its housing can be inserted into the interior of the annular design.

Figure 2:
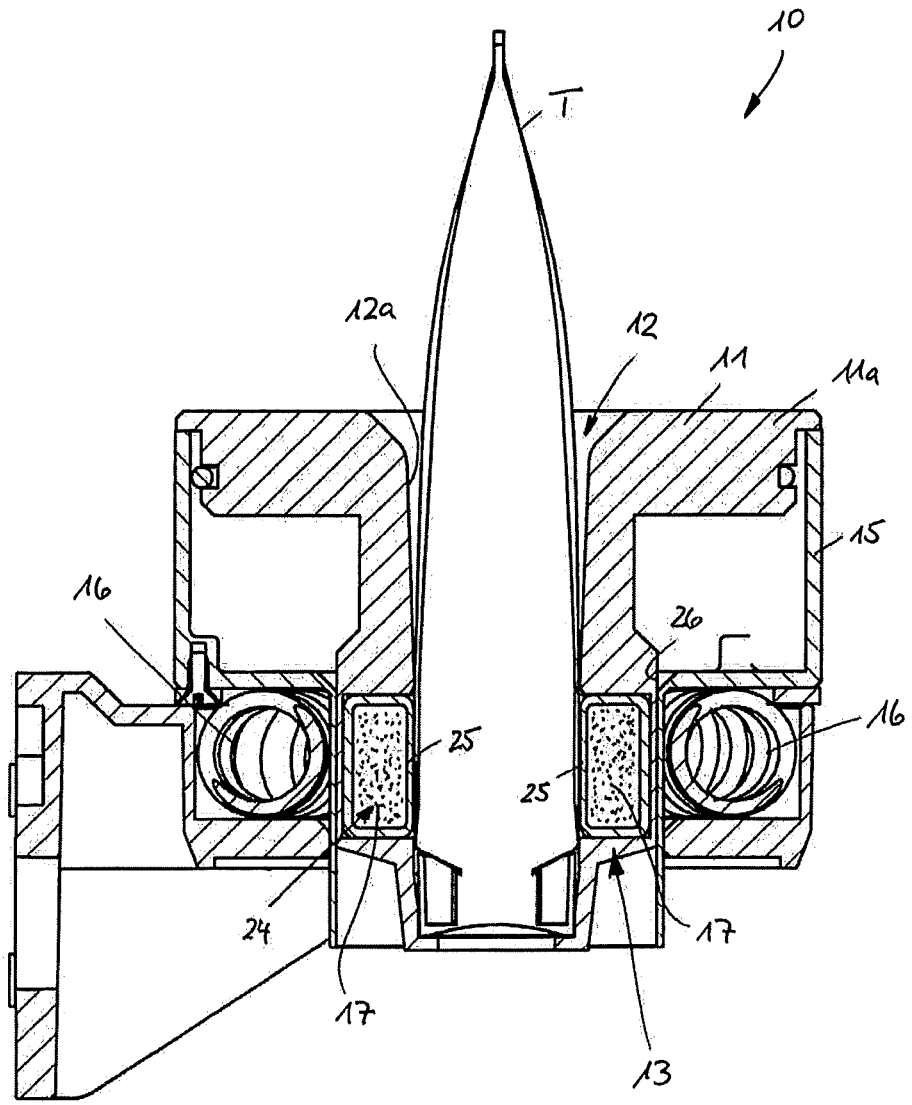
Figure 3:
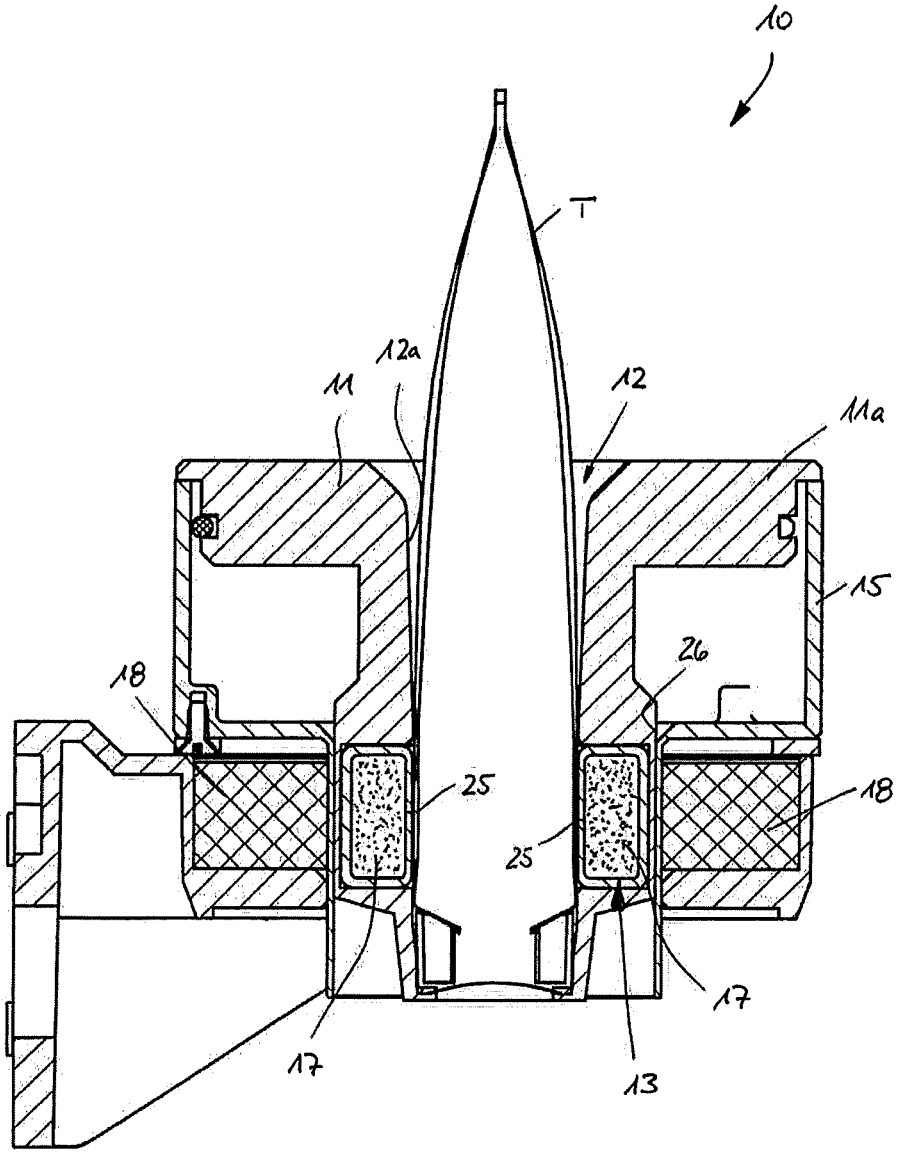
Figure 4:
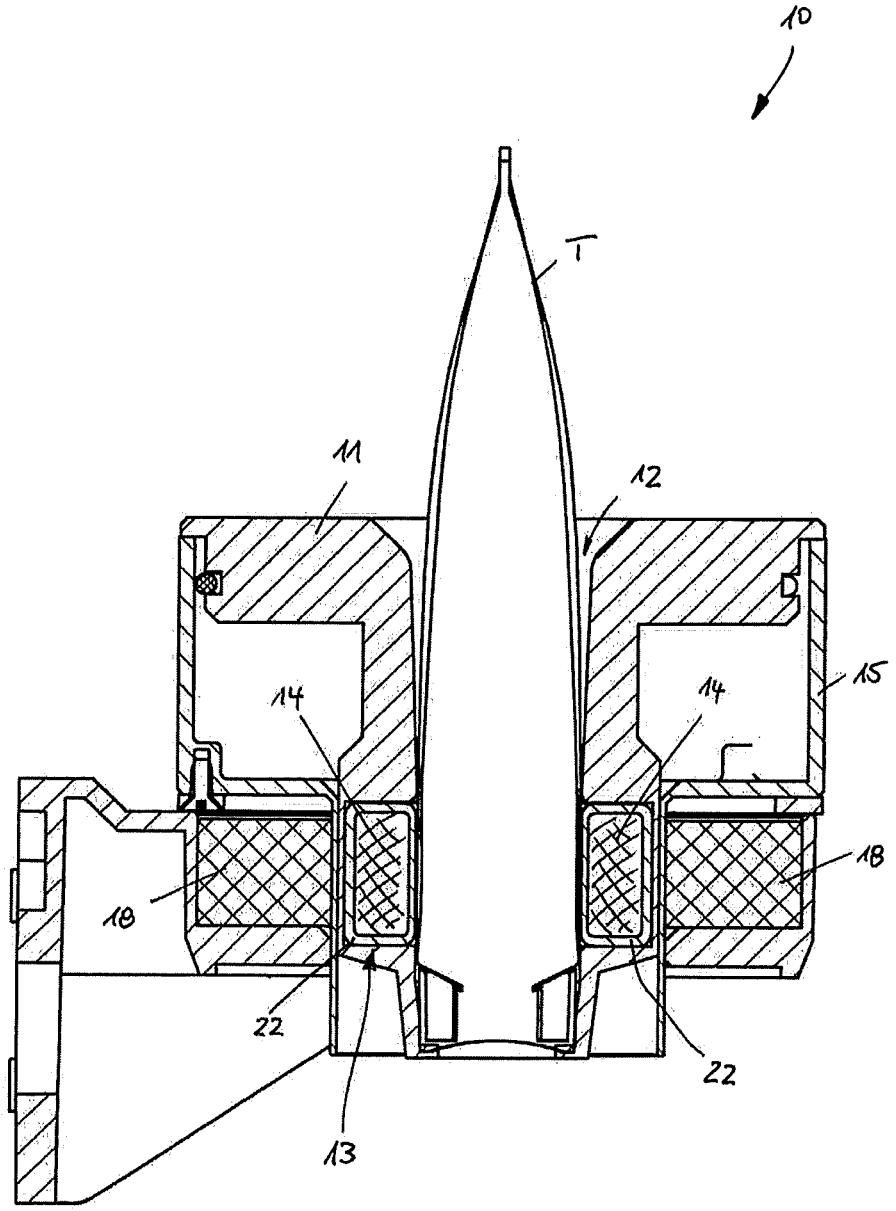
Figure 5:
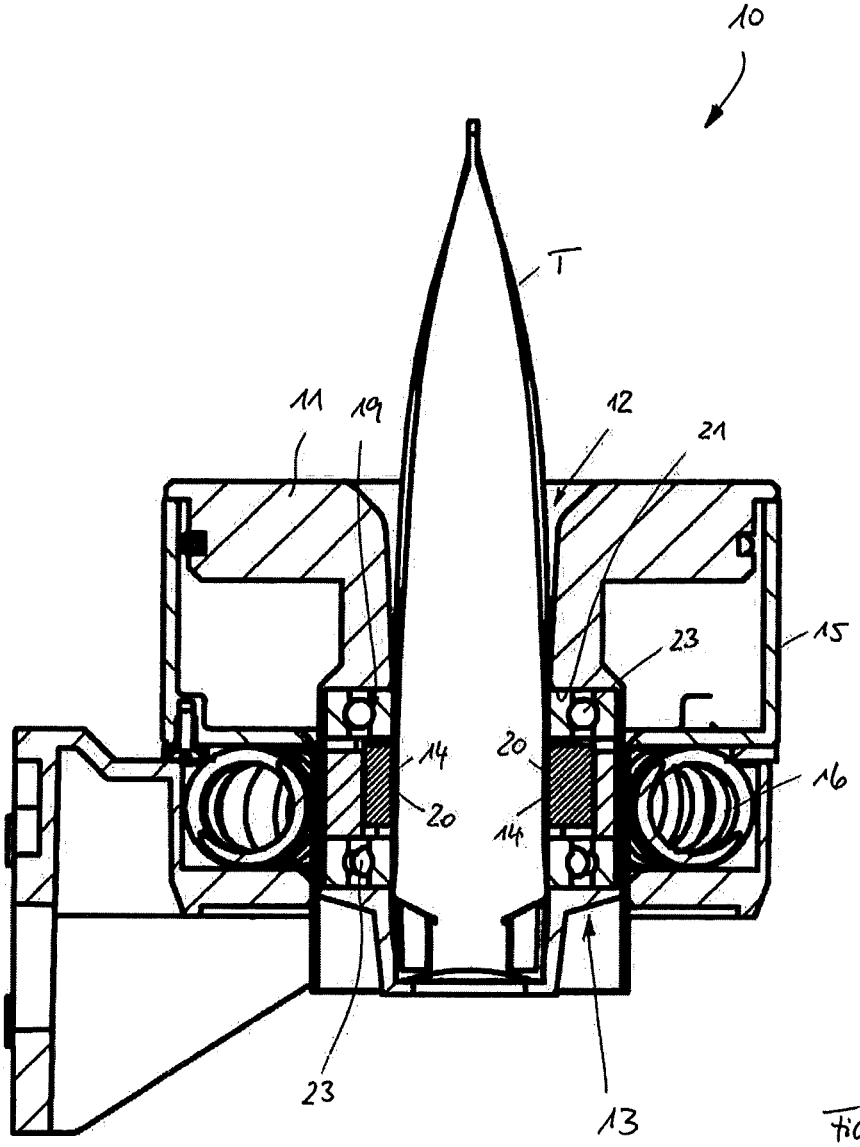

Further details and features of the invention can be seen from the following description of exemplary embodiments with reference to the drawing, in which:

FIG. 1 shows a schematic sectional representation of a tube holder according to a first exemplary embodiment, FIG. 2 shows a schematic sectional representation of a tube holder according to a second exemplary embodiment, FIG. 3 shows a schematic sectional representation of a tube holder according to a third exemplary embodiment, FIG. 4 shows a schematic sectional representation of a tube holder according to a fourth exemplary embodiment and FIG. 5 shows a schematic sectional representation of a tube holder according to a fifth exemplary embodiment.

A tube holder 10 shown in FIG. 1 has a cup-shaped housing 11 which tapers conically at its lower end and comprises a radially protruding, circumferential flange 11*a* in the upper region. A cylindrical vertical through bore, which forms a tube receiving means 12 and has an inner wall 12*a*, is realized in the housing 11. A circumferential chamber 21, which is filled with a clamping part 22 which consists of a soft elastic, easily deformable material, is realized in the lower region of the axial length of the tube receiving means 12, in the inner wall 12*a* thereof. As shown in FIG. 1, the clamping part 22 forms a portion of the circumferential boundary of the tube receiving means 12.

Multiple magnets 14 distributed over the periphery are embedded in the material of the clamping part 21. The magnets 14 are connected to the material of the clamping part 22 such that movement of the magnets 114 results in deformation of the clamping part 22.

The housing 11 is inserted into a receiving opening 26 of a substantially annular housing receiving means 15, the housing 11 reaching through the receiving opening 26. An electric coil 16, which is connected to an electrical voltage source in a manner not shown, is arranged in the vicinity of the receiving opening 26, in the interior of the housing receiving means 25. When the housing 11 is inserted into the housing receiving means 15, as shown in FIG. 1, the magnets 14 are located in the vicinity of the electric coil 16 and within the same. When the electric coil 16 is traversed with current, a magnetic field is formed. As long as there is no magnetic field present, the magnets 14 are displaced radially inward, i.e. in the direction of the tube receiving means 12. This results in the clamping part 22 protruding into the tube receiving means 12, as shown by the broken line in FIG. 1. As a result, a tube shown in FIG. 1 can be clamped in the tube receiving means 12.

As soon as the electric coil 16 is traversed by current, a magnetic field is present and the magnets 14 together with the clamping part 22 take up their releasing position which is shown by the continuous line in FIG. 1.

FIG. 2 shows an alternative design of the tube holder 10. This differs from the design according to FIG. 1 substantially as a result of a fluid chamber 24 now being provided in the inner wall 12*a* of the tube receiving means 12, which fluid chamber is delimited in relation to the tube receiving means 12 by a flexible wall 25, for example in the form of a film. A magnetorheological fluid 17 is arranged in the fluid chamber 24.

When the tube holder 10 is inserted into the receiving opening 26 of the housing receiving means 15, as shown in FIG. 2, the fluid chamber 24, which is preferably realized as a circumferential annular chamber, is situated in the region in the interior of the electric coil 16. When a current flows through said electric coil, a magnetic field is built up, as a result of which the viscosity of the magnetorheological fluid 17 in the fluid chamber 24 changes and it becomes increasingly inviscid. An inserted tube T is fixed in the tube holder 10 on the outside as long as no magnetic field is present due to the coil 16. As soon as a magnetic field is present on account of the coil 16, the tube T is released, as shown in FIG. 2.

As soon as the electric coil 16 is no longer traversed by current, no magnetic field is present and the magnetorheological fluid 17 clamps the tube T again.

The embodiment shown in FIG. 3 differs from the embodiment shown in FIG. 2 in that permanent magnets 18 are now arranged in the housing receiving means 15 instead of a coil. When the housing 11 is lifted from the housing receiving means 15, the magnetorheological fluid 17 flows out of the magnetic field of the permanent magnets 18, as a result of which its viscosity increases and the tube T is held securely. When the housing 11 is then inserted with an inserted tube T into the housing receiving means 15, the magnetorheological fluid 17 flows into the magnetic field of the permanent magnets 18, as a result of which the viscosity of the magnetorheological fluid 17 drops and the tube T is released.

FIG. 4 shows a modification of the design according to FIG. 1. In this case, the magnets 14 continue to be embedded in the material of the clamping part 22 but the outer coil arranged in the housing receiving means 15 is replaced by the permanent magnet 18. When the tube holder 10 is inserted into the tube receiving means 12, the magnets 14 on the one side and the permanent magnets on the other side 18 attract. As the permanent magnets 18 are held so as to be non-displaceable, this results in the clamping part 22 deforming elastically radially outward, i.e. away from the tube T, as a result of which the tube is released.

FIG. 5 shows a further modification of the design according to FIG. 1. The magnets 14 are now not embedded in the material of a clamping part but are displaceable longitudinally of a guide 19, which includes bearings and in particular ball bearings 23, and are, in particular, rotatable or rotational about the longitudinal axis of the tube receiving means 12. Clamping elements 20 are provided on the inner wall 12*a* of the tube receiving means 12. The displacement or rotation of the magnets 14 on account of a magnetic field which is generated by the coil 16, is transmitted mechanically to the clamping elements 20, as a result of which a tube T located in the tube receiving means 12 is clamped or released.

When no more current flows through the electric coil 16 and consequently no magnetic field is present, the magnets 14 return into their initial position, as a result of which the clamping elements 20 preferably clamp the tube.

The invention claimed is:

1. A tube holder for a tube-filling machine comprising a cup-shaped housing which comprises an upwardly opening tube receiving means into which a tube is insertable by way of one axial end region thereof, wherein a clamping device, by which a clamping force can be applied to the tube, is arranged in the region of the inner wall of the tube receiving means, wherein the clamping device comprises a magnetorheological fluid, the viscosity of which is modifiable by at least one electric coil and/or at least one permanent magnet.

2. The tube holder as claimed in claim 1, wherein the magnetorheological fluid is arranged in a fluid chamber which forms at least one portion of the inner wall of the tube receiving means with a flexible wall.

3. The tube holder as claimed in claim 2, wherein the fluid chamber is realized as a circumferential annular chamber.

4. The tube holder as claimed in claim 2, wherein the housing sits in a housing receiving means and in that the at least one electric coil and/or the at least one permanent magnet are arranged in or on the housing receiving means.

5. The tube holder as claimed in claim 4, wherein the housing receiving means is realized in an annular manner.

* * * * *